US007857712B2

(12) United States Patent
Nishitani et al.

(10) Patent No.: US 7,857,712 B2
(45) Date of Patent: Dec. 28, 2010

(54) GOLF CLUB HEAD

(75) Inventors: Masafumi Nishitani, Kawasaki (JP); Hisashi Yamagishi, Hanno (JP); Makoto Kubota, Kawaguchi (JP); Koki Motoyoshi, Hanno (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 1253 days.

(21) Appl. No.: 11/119,887

(22) Filed: May 3, 2005

(65) Prior Publication Data

US 2005/0250594 A1 Nov. 10, 2005

(30) Foreign Application Priority Data

May 7, 2004 (JP) ..... P2004-138774

(51) Int. Cl.
*A63B 53/04* (2006.01)

(52) U.S. Cl. ..... 473/342

(58) Field of Classification Search ..... 473/324–350
See application file for complete search history.

(56) References Cited

U.S. PATENT DOCUMENTS

| | | | | |
|---|---|---|---|---|
| 4,181,306 | A * | 1/1980 | Jepson | 473/342 |
| 4,420,156 | A | 12/1983 | Campau | |
| 4,852,880 | A * | 8/1989 | Kobayashi | 473/349 |
| 5,062,638 | A | 11/1991 | Shira | |
| 7,018,305 | B2 * | 3/2006 | Sugimoto | 473/342 |

FOREIGN PATENT DOCUMENTS

| | | | |
|---|---|---|---|
| JP | 38-19176 | B | 9/1938 |
| JP | 58-169474 | A | 10/1983 |
| JP | 59-179776 | A | 10/1984 |
| JP | 63-229078 | A | 9/1988 |
| JP | 02101153 | A * | 4/1990 |
| JP | 8-191908 | A | 7/1996 |
| JP | 8-206260 | A | 8/1996 |
| JP | 9-99120 | A | 4/1997 |
| JP | 10-5376 | A | 1/1998 |
| JP | 10-216275 | A | 8/1998 |
| JP | 11-9734 | A | 1/1999 |
| JP | 2002-143355 | A | 5/2002 |

OTHER PUBLICATIONS

Jackson, Jeff. THe Modern Guide to Golf Clubmaking. Ohio: Dynacraft Golf Products, Inc., copyright 1994, p. 237.*

Japanese Office Action dated Dec. 14, 2009 issued in Application No. 2004-138774, 6 pages.

Notification of Reason for Refusal dated Mar. 30, 2010, in counterpart Japanese Application No. 2004-138774.

* cited by examiner

*Primary Examiner*—Alvin A Hunter
(74) *Attorney, Agent, or Firm*—Sughrue Mion, PLLC

(57) ABSTRACT

An iron-type golf club head has a face which has a face surface of a flat shape, and a hosel which is continuous with the face on its heel side. A shaft insertion hole is disposed in the hosel. A protrusion protruding rearward is disposed in the vicinity of the center in a toe-heel direction. A material of the golf club head is pure iron having a high purity of at least 99.8%, for instance, pure iron having a purity within a range of 99.995 to 99.9999%. The golf club head is subjected to carburizing so that carbon diffuses up to about 0.2 to 0.5 mm from the surface. A region within 0.2 mm from the face surface has a hardness of HV 300 to 600, and a region where a distance from the face surface is 0.7 mm or more has a hardness of HV 100 or lower.

15 Claims, 2 Drawing Sheets

GOLF CLUB HEAD

BACKGROUND OF THE INVENTION

1. Field of the Invention

The present invention relates to an iron-type golf club head, particularly to a golf club head of which at least a face is made of an iron material, and at least a face surface is carburized.

2. Description of the Related Art

As a material for an iron-type golf club head, a soft iron, stainless steel, a beryllium alloy, a copper alloy, and the like, has been used. In addition, an iron golf club head of a composite type whose peripheral edge section is made of stainless steel, and to which a face plate made of a titanium alloy is attached has come into widespread use in recent years. Hereinbelow, an iron-type golf club head is often referred to as an "iron head."

An iron head made of pure iron whose purity falls within a range of 99.93 to 99.97% is disclosed in JP-A-63-229078. In lines 1 to 8, upper left column, page 3 of the specification, it is disclosed that pure iron has great elongation and drawing ratio, and is superior in malleability, accordingly, a contact area between a golf ball and a face of the iron head made of pure iron is expanded, and a contact time is elongated, thereby enhancing directional stability of a hit ball.

Forming a surface-hardening layer on an iron head made of a soft iron material by means of carburizing or nitriding is disclosed in JP-A-8-206260.

Application of plasma carburizing or gas carburizing to an iron head made of a structural alloy steel, stainless steel, titanium, or a titanium alloy steel so as to increase surface hardness, thereby enhancing a carry distance of a hit ball is disclosed in JP-A-10-5376 (paragraph Nos. [0008] through [0017]).

A golf club head which is made of titanium or a titanium alloy and whose surface is hardened by means of carburizing or nitriding so as to have a surface hardness of HV (hardness value of Vickers) 450 to 1,000 is disclosed in JP-A-10-216275.

A material generally employed for a golf club head, such as a structural alloy steel, stainless steel, or a titanium alloy steel, has a high hardness of about HV 300 to 400. Meanwhile, pure titanium is of a hardness similar to that of soft iron, about HV 110 to 150.

As compared with an iron head made of stainless steel, an iron head made of pure iron is lower in material hardness and produces a softer ball-hit feeling. However, because of low abrasive resistance, the iron head made of pure iron is easily damaged on its surface, and angular edges of score lines (lateral grooves on a face surface) are rounded at an early stage, thereby making it difficult to impart spin to a hit ball. In addition, when the iron head is used in such a rounded condition, micro deformations caused by impacts applied at the time of hitting a ball are accumulated, thereby changing a loft angle and the like.

Increasing surface hardness of an iron head made of a soft iron material or an alloy steel by means of carburizing is disclosed in the above-mentioned JP-A-8-206260 and JP-A-10-5376, however, application of carburizing to an iron head made of a pure iron material is not described therein.

The golf club head disclosed in the above-mentioned JP-A-10-216275 is for a driver-type golf club. Accordingly, when an iron head is imparted with a surface hardness of HV 450 to 1,000 as disclosed in the specification, surface hardness of a face surface thereof becomes too high, resulting in an inferior ball-hit feeling.

SUMMARY OF THE INVENTION

The present invention provides a golf club head which is superior in ball-hit feeling as well as in abrasive resistance.

According to aspect 1 of the invention, a golf club head is made of an iron material and at least a face surface is carburized, and is characterized in that a region within 0.2 mm of the face surface has a hardness of HV 300 to 600, and a region where a distance from the face surface is 0.7 mm or more has a hardness of HV 100 or lower.

The invention of aspect 2 is the golf club head characterized in that in the golf club head of aspect 1, the iron material is pure iron.

The invention of aspect 3 is the golf club head characterized in that in the golf club head of aspect 2, purity of the pure iron is at least 99.8%.

The invention of aspect 4 is the golf club head characterized in that in the golf club head of aspect 1, the iron-type golf club head has a loft angle of 25° or more.

The invention of aspect 5 is the golf club head characterized in that in the golf club head of aspect 1, thickness of a face in the vicinity of a center of gravity thereof falls within a range from 3.5 to 15 mm.

The invention of aspect 6 is the golf club head characterized in that in the golf club head of aspect 1, the face is smaller in thickness on its toe side and on its heel side than in the vicinity of its center of gravity.

The invention of aspect 7 is the golf club head characterized in that in the golf club head of aspect 1, wherein the hardness of the face surface falls within a range of HV 350 to 550.

The golf club head of the invention is configured such that a region within 0.2 mm of the face surface has a hardness of HV 300 to 600, and a region where a distance from the face surface is 0.7 mm or more has a hardness of HV 100 or lower. Accordingly, the golf club head provides softball-hit feeling, and is particularly suitable for use in an iron-type golf club having a loft angle greater than or equal to 25° and from which a soft touch upon hitting of a ball is expected, and is further particularly suitable for use in a wedge-type head.

In the invention, the pure iron is preferably pure iron whose purity is 99.8% or more, particularly preferably high-purity iron whose purity is 99.95% or more. Accordingly, ball-hit feeling becomes fairly soft, and stainless property is also improved, which is advantageous.

According to the invention, sufficient carburizing is applied to a range of 0.2 mm in depth from the surface of the head made of the pure iron. Accordingly, the head exhibits favorable abrasive resistance.

Since the face of the iron club head of the invention is made of pure iron, it may lack sufficient strength. To this end, the face in the vicinity of its center of gravity at which a ball hits is preferably reinforced so as to have a thickness of 3.5 to 15 mm. In addition, when the thickness of the face in the vicinity of the center of gravity is increased, a fairly favorable tactile response is obtained when a ball is hit in the vicinity of the center of gravity of the face (a so-called hitting a ball on the centroid making solid contact with the ball).

Meanwhile, in order to suppress an increase in weight of the iron head, the following is preferable, that is, the thickness in the vicinity of the center of gravity of the face is increased while thicknesses of the remaining portions are rendered smaller. More specifically, the face is preferably smaller in thickness on its toe side and on its heel side than in the vicinity of its center of gravity.

According to the invention, carburizing is preferably applied so that hardness of the face surface (i.e., hardness on the surface of the face) falls within a range of about HV 300 to 600.

DETAILED DESCRIPTION OF THE INVENTION

Figure 1:
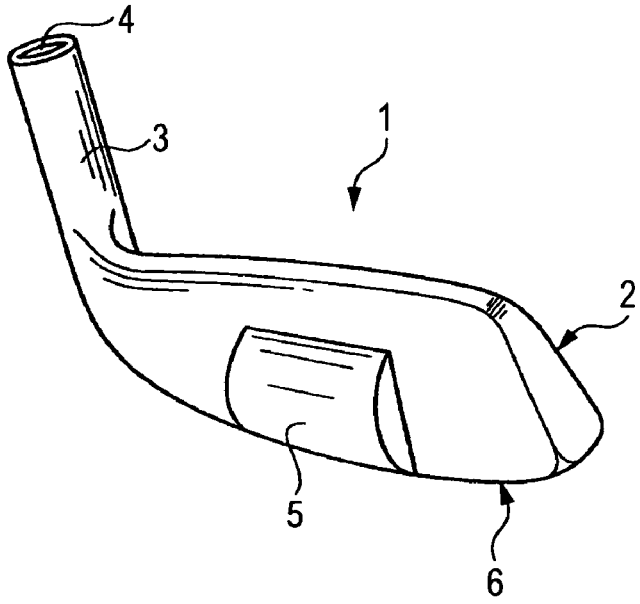
FIG. 1 is a perspective view of an iron-type golf club head according to an embodiment of the invention, as viewed from the rear.
Figure 2:
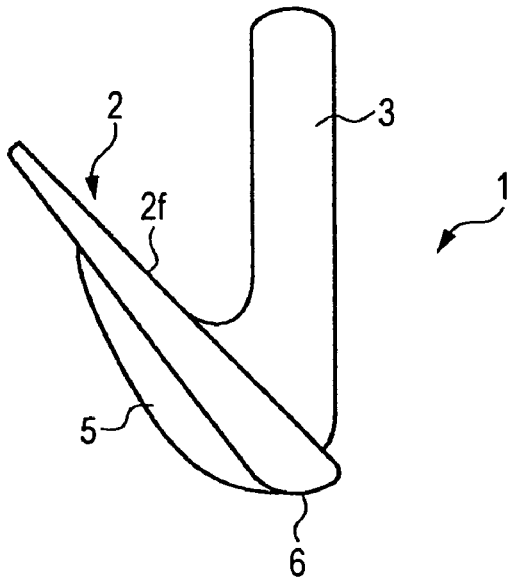
FIG. 2 is a side view of the iron-type golf club head according to the embodiment.

Hereinafter, the invention will be described in further detail by reference to the drawings. FIG. 1 is a perspective view of a golf club head according to an embodiment of the invention, as viewed from the rear. FIG. 2 is a side view of the same as viewed from the toe side thereof.

An iron-type golf club head 1 has a face 2 which has a face surface 2*f* of a flat shape, and a hosel 3 which is continuous with the face 2 on its heel side. A shaft insertion hole 4 is disposed in the hosel 3. A tip of a golf club shaft is inserted into the shaft insertion hole 4, and fixedly attached thereto by means of an adhesive.

The golf club head 1 shown in the drawings is a wedge-type head whose loft angle is 45°. On the backside of the golf club head 1, a protrusion 5 protruding rearward in the vicinity of the center in a toe-heel direction is disposed. The face 2 is substantially uniform in thickness, except for the protrusion 5.

In the meantime, the face 2 has its greatest thickness at a sole 6 side (bottom section side), and thickness is gradually reduced upward.

The protrusion 5 is located rearward of the center of gravity of the face 2 (i.e., rearward in a state where the sole of the head 1 is in contact with the ground).

The protrusion 5 is preferably located within a range of about 10 to 90%, particularly preferably about 20 to 80%, in terms of a ratio of a total length of the head 1 in the toe-heel direction and a distance from the protrusion 5 to the farther of the toe and the heel.

A lowest portion of the protrusion 5 desirably reaches the sole 6. When the head 1 is configured as above, the center of gravity thereof can be lowered. In addition, in the embodiment, the outer surface of the protrusion 5 is rendered smoothly continuous with the sole 6 as shown in FIG. 2. By virtue of the above configuration, the lower portion of the protrusion 5 can be utilized as a bounce angle of the head 1.

A material of the golf club head 1 is pure iron preferably having a high purity of at least 99.995%, for instance, within a range of 99.995 to 99.9999%. The pure iron having such a high purity is superior in stainless property.

The head 1 is subjected to carburizing so that carbon diffuses up to about 0.2 to 0.5 mm, preferably about 0.3 to 0.45 mm, from the surface. The carburizing may be applied to only the face surface 2*f* or to the entire head. The carburizing may be either gas carburizing or plasma carburizing. The carburizing may be effected by other methods. Meanwhile, as a method for carburizing, gas carburizing is convenient. In gas carburizing, a golf club head is caused to come into contact with carburizing gas, such as CO gas, under a heated condition.

As a result of the carburizing, a region within 0.2 mm of the face surface has a hardness of HV 300 to 600, preferably HV 350 to 550, further preferably HV 370 to 500, and a region where a distance from the face surface is 0.7 mm or more has a hardness of HV 100 or lower. Hardness of the surface of the face desirably falls within a range of HV 300 to 600, preferably HV 350 to 550, and particularly preferably HV 370 to 500. At a depth of 0.1 mm from the face surface, hardness is preferably HV 250 to 400, particularly HV 300 to 400, at a depth of 0.2 mm from the face surface, hardness is preferably HV 200 to 280, particularly HV 220 to 270, and at a depth of 0.5 mm from the face surface, hardness is preferably about HV 70 to 120.

The golf club head 1 configured as above has a hardness distribution such that hardness is slightly higher only at the surface and in the vicinity of the face surface, and lower inside the face. Accordingly, the golf club head 1 provides soft ball-hit feeling and is superior in stainless property. In addition, since the golf club head 1 is carburized, superior abrasive resistance is also exhibited. Furthermore, since the golf club head 1 is made of pure iron, superior stainless property is exhibited.

The golf club head 1 is provided with the protrusion 5. Accordingly, the face 2 is high in strength, and fairly superior in tactile response when a ball is hit in the vicinity of the center of gravity of the face. In addition, the golf club head 1 has the center of gravity at a deep position, and therefore a wide sweet area.

Of the golf club head 1, the protrusion 5 reaches the sole 6. Accordingly, the center of gravity is at a low position, thereby facilitating hitting a ball high.

The golf club head of the invention is suitable for an iron head whose loft angle is greater than or equal to 25°, particularly suitable for a wedge-type head whose loft angle is greater than or equal to 40°. However, the golf club head 1 is also applicable to a head of a utility club made of an iron material and having a shape approximating that of an iron head.

A member made of a material of high specific gravity, such as tungsten, may be attached onto the sole of the golf club head of the invention. In addition, a hollow may be disposed inside the face, and filled with a vibration absorption material such as rubber or elastomer.

The golf club head can be manufactured by means of any of forging (e.g., die forging), press molding, casting, and the like.

EXAMPLES

Examples and comparative examples will be described hereinbelow.

Examples 1 to 3

From pure iron having a purity of 99.997%, an iron head of wedge-type having a shape as shown in FIGS. 1 and 2 was manufactured by means of forging. The hosel hole and the score lines on the face surface were formed by means of machining. After the above work, the entire head surface was subjected to carburizing in a gas carburizing furnace. As a carburizing gas, a gas mixture containing 10 vol % CO, 20 vol % $H_2$, 1 vol % $CO_2$, and 69 vol % $N_2$ was used, and the carburizing was performed at 480° C.

Figure 3:
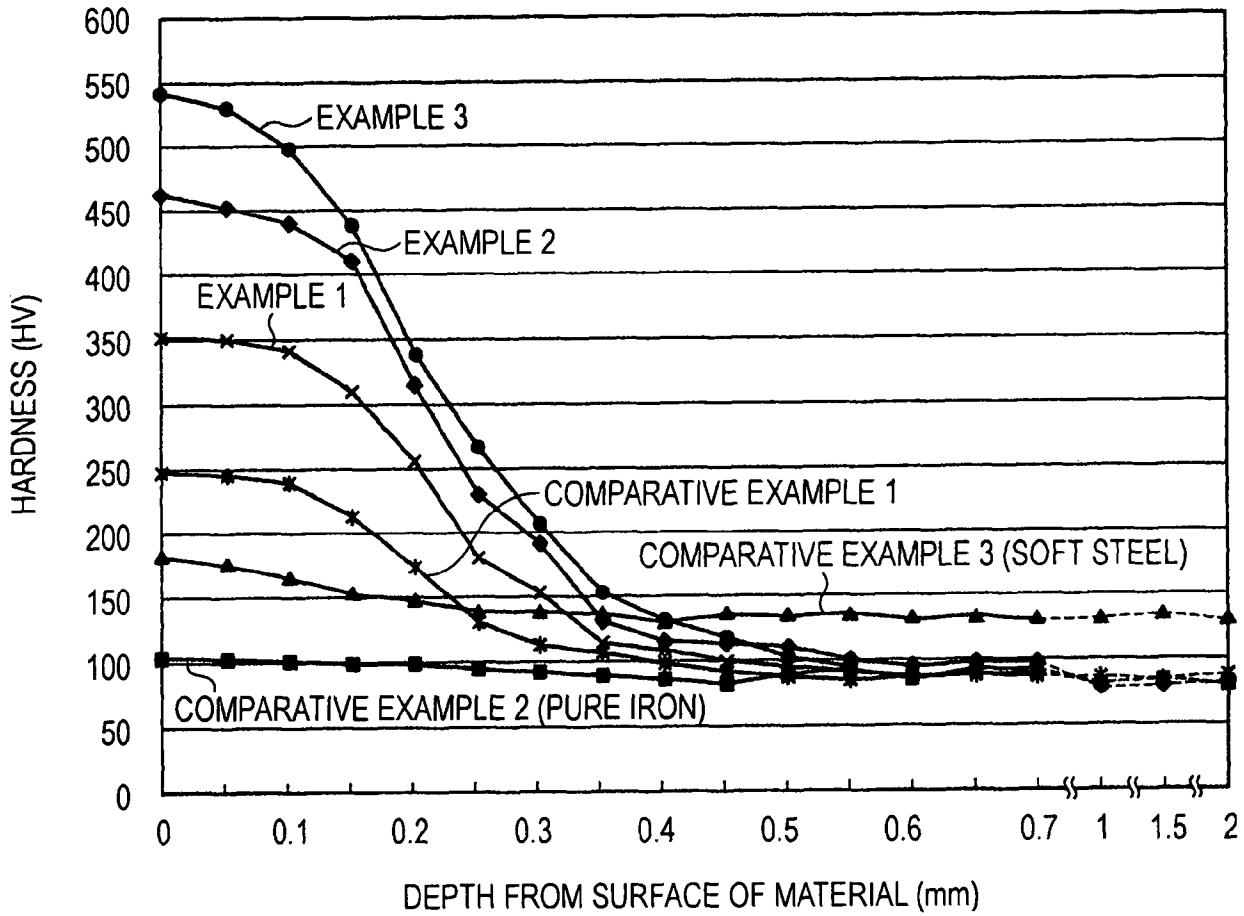
FIG. 3 is a graph showing a hardness distribution in depth profile of a face of each of examples and comparative examples.

Hardness of the face surface was adjusted by means of adjusting the time of carburizing treatment. Surface hardness was HV 350 in example 1, HV 460 in example 2, and HV 540 in example 3. FIG. 3 shows hardness distribution along the depth profile of the face of the iron head.

Comparative Example 1

An iron head was manufactured in a manner similar to that example 1, except that the time of carburizing treatment was shortened. Hardness distribution was measured, and the results are shown in FIG. 3.

Comparative Example 2

An iron head was manufactured in a manner to that of example 1, except that the carburizing treatment was not performed. Hardness distribution was measured, and the results are shown in FIG. 3.

Comparative Example 3

An iron head was manufactured in a manner similar to that of example 1, except that soft steel whose carbon content was 0.2% was used in place of the pure iron and the carburizing treatment was not performed. Hardness distribution was measured, and the results are shown in FIG. 3.

As shown in FIG. 3, the heads of examples 1 to 3 have hardness (HV) distributions as follows:

on the surface: 350 (example 1), 460 (example 2), 540 (example 3);

at a depth of 0.1 mm: 340 (example 1), 440 (example 2), 500 (example 3);

at a depth of 0.2 mm: 260 (example 1), 320 (example 2), 340 (example 3);

at a depth of 0.5 mm: 90 (example 1), 120 (example 2), 110 (example 3); and at a depth of 0.7 mm: 90 (example 1), 90 (example 2), 90 (example 3). The above results reveal that the hardness falls within the preferable range of the invention.

Furthermore, a carbon shaft was attached to each of the iron heads of examples 1 to 3 and comparative examples 1 to 3, and ball-hit feeling was studied by means of actual hitting of a ball therewith. The results are as follows:

examples 1 to 3: soft and favorable;

comparative examples 1 and 3: slightly too soft; and comparative example 2: considerably too soft.

What is claimed is:

1. A golf club head made of an iron material and of which at least a face surface is carburized, wherein a region within 0.2 mm of the face surface has a hardness of HV 300 to 600, and a region where a distance from the face surface is 0.7 mm or more has a hardness of HV 100 or lower.

2. The golf club head according to claim 1, wherein the iron material is pure iron.

3. The golf club head according to claim 2, wherein purity of the pure iron is at least 99.8%.

4. The golf club head according to claim 1, wherein the golf club head is an iron-type golf club head whose loft angle is 25° or more.

5. The golf club head according to claim 1, wherein thickness of a face in a vicinity of a center of gravity thereof falls within a range from 3.5 to 15 mm.

6. The golf club head according to claim 5, wherein the face is of smaller thickness on its toe side and on its heel side than in a vicinity of its center of gravity.

7. The golf club head according to claim 1, wherein hardness of the face surface falls within a range of HV 350 to 550.

8. A golf club head made of an iron material and of which at least a face surface is carburized, wherein the face surface has a hardness of HV 350 to 400, a second portion at a depth of 0.2 mm from the face surface has a hardness of HV 200 to 280, and a third portion at a depth of 0.5 mm from the face surface has a hardness of HV 70 to 120.

9. The golf club head according to claim 8, wherein the iron material is pure iron.

10. The golf club head according to claim 8, wherein purity of the pure iron is at least 99.8%.

11. The golf club head according to claim 8, wherein the golf club head is an iron-type golf club head whose loft angle is 25° or more.

12. The golf club head according to claim 8, wherein thickness of a face in a vicinity of a center of gravity thereof falls within a range from 3.5 to 15 mm.

13. The golf club head according to claim 8, wherein the face is of smaller thickness on its toe side and on its heel side than in a vicinity of its center of gravity.

14. The golf club head according to claim 1, wherein a softest portion in said golf club head has a hardness of HV 100 or lower.

15. The golf club head according to claim 8, wherein a softest portion in said golf club head has a hardness of HV 100 or lower.

* * * * *